US011890658B2

(12) United States Patent
Zhang et al.

(10) Patent No.: US 11,890,658 B2
(45) Date of Patent: Feb. 6, 2024

(54) LARGE-WIDTH CATHODE ROLLER FOR PRODUCING HIGH-STRENGTH ULTRA-THIN COPPER FOIL

(71) Applicant: Xi'an Taijin Industrial Electrochemical Technology Co., Ltd., Xi'an (CN)

(72) Inventors: Le Zhang, Xi'an (CN); Qing Feng, Xi'an (CN); Siqi Wang, Xi'an (CN); Chu Shen, Xi'an (CN); Xiuling He, Xi'an (CN); Bo Yang, Xi'an (CN); Dong Miao, Xi'an (CN)

(73) Assignee: Xi'an Taijin New Energy & Materials Sci-Tech Co., Ltd., Xi'an (CN)

( * ) Notice: Subject to any disclaimer, the term of this patent is extended or adjusted under 35 U.S.C. 154(b) by 0 days.

(21) Appl. No.: 18/063,864

(22) Filed: Dec. 9, 2022

(65) Prior Publication Data

US 2023/0182184 A1 Jun. 15, 2023

(30) Foreign Application Priority Data

Dec. 13, 2021 (CN) ..... 202111521532

(51) Int. Cl.
*C25D 1/04* (2006.01)
*B21B 1/24* (2006.01)
*B21B 3/00* (2006.01)

(52) U.S. Cl.
CPC ..... *B21B 1/24* (2013.01); *C25D 1/04* (2013.01); *B21B 2003/005* (2013.01); *B21B 2203/18* (2013.01)

(58) Field of Classification Search
None
See application file for complete search history.

(56) References Cited

U.S. PATENT DOCUMENTS 4,975,169 A * 12/1990 Murayama ..... C25D 1/04 204/216
5,019,221 A * 5/1991 Khalid ..... C25D 1/04 204/216

FOREIGN PATENT DOCUMENTS

CN 2820882 Y 9/2006
CN 107937940 A 4/2018

OTHER PUBLICATIONS

English translation CN 210796661 (Year: 2020).*
English translation JP 2003201591 (Year: 2003).*
English translation CN 101270496 (Year: 2008).*

* cited by examiner

*Primary Examiner* — Stefanie S Wittenberg
(74) *Attorney, Agent, or Firm* — Novoclaims Patent Services LLC; Mei Lin Wong

(57) ABSTRACT

A large-width cathode roller for producing high-strength ultra-thin copper foil includes titanium side plates and a titanium cylinder sealed by the titanium side plates, and a cathode roller core penetrated through the titanium side plates. Steel-copper explosive clad cylinders and a steel support plate are disposed in/on the side plate, inner ring surfaces of the side plates and the copper plates are connected to a copper sleeve around the cathode roller core, outer ring surfaces of the copper plates and the steel support plates are connected to a copper cylinder, inner ring surfaces of the steel support plates are connected to the cathode roller core; and multiple electrically conductive support rings on the copper cylinder are connected to the copper plates on two sides through the electrically conductive copper bars to form a conducting loop to improve the distribution uniformity of the current on the surface of the cathode roller.

8 Claims, 5 Drawing Sheets

LARGE-WIDTH CATHODE ROLLER FOR PRODUCING HIGH-STRENGTH ULTRA-THIN COPPER FOIL

CROSS REFERENCE OF RELATED APPLICATION

This is a non-provisional application that claims priority to a Chinese application, application number CN202111521532.6, filed on Dec. 13, 2021, the entire contents of which is expressly incorporated herein by reference.

BACKGROUND OF THE PRESENT INVENTION

Field of Invention

The invention belongs to the technical field of production of high-strength ultra-thin copper foil, and particularly relates to a large-width cathode roller for producing high-strength ultra-thin copper foil.

BACKGROUND OF THE INVENTION

Description of Related Arts

Copper foil, as a cathodic electrolysis material, is a layer of thin and continuous metal foil deposited on the base layer of circuit boards, and it is adhered to an insulating layer and forms a circuit pattern after being corroded by a print protection layer. Wherein, the copper foil is an important material for producing lithium ion batteries, and especially, the use of high-strength ultra-thin copper foil can greatly improve the energy density of batteries and reduce raw material consumption and costs.

In recent years, the rapid development of the new energy automobile industry leads to an increasing demand for high-strength ultra-thin copper foil. At present, the electrolytic process is often used for producing copper both in China and in foreign countries. The cathode roller is the core equipment for producing copper foil through the electrolytic process, so high requirements are put forward for the cathode roller in the copper foil industry, and more and more copper foil producers hope to increase the yield by improving the width of the cathode roller, so as to reduce the production cost. For example, in China, cathode rollers with the diameter φ2700 mm typically have a width of 1380 mm, 1450 mm and 1550 mm, and cathode rollers with an even larger width are rarely reported. The main technical difficulty limiting the development of large-width cathode rollers is the uniformity of the current on the surface of the large-width cathode rollers. Due to the fact that the current density of the two sides of the surface of large-width cathode rollers of a conventional design structure is higher than that of the middle portion of the surface of these cathode rollers, the distribution of the current on the whole surface of the cathode rollers is non-uniform, so the quality of produced copper foil cannot meet requirements, and corresponding problems will be caused when the copper foil is rolled and stripped, reducing the product quality, increasing the cost and reducing the efficiency. Thus, how to solve the problem of non-uniform distribution of the current on the surface of large-width cathode rollers through the design of the conducting structure has become the key to making large-width cathode rollers.

In view of this, the inventor provides a large-width cathode roller for producing high-strength ultra-thin copper foil to solve the above-mentioned practical problems.

SUMMARY OF THE PRESENT INVENTION

The objective of the invention is to overcome the defects of the prior art by providing a large-width cathode roller for producing high-strength ultra-thin copper foil. The problem of non-uniform electrical conduction of the surface of the cathode roller is effectively solved, the width of the cathode roller can be over 2 m, and the cathode roller can be used for producing high-strength ultra-thin copper foil with a thickness of 4.5 μm.

The objective of the invention is fulfilled through the following technical solution:

A large-width cathode roller for producing high-strength ultra-thin copper foil comprises a cathode roller core, titanium side plates and a titanium cylinder, wherein two ends of the titanium cylinder are sealed by the titanium side plates, and the cathode roller core penetrates through the center of the titanium side plates;

A steel cylinder and a copper cylinder are disposed in the titanium cylinder, and the steel cylinder is located between the titanium cylinder and the copper cylinder and is in contact with the titanium cylinder and the copper cylinder;

A first copper plate, a second copper plate and a steel support plate are sequentially connected to and disposed on an inner side of each titanium side plate; an inner ring surface of the titanium side plate, an inner ring surface of the first copper plate and an inner ring surface of the second copper plate are all connected to a copper sleeve disposed around the cathode roller core, an outer ring surface of the second copper plate and an outer ring surface of the steel support plate are connected to an inner wall of the copper cylinder, an inner ring surface of the steel support plate is connected to the cathode roller core, and an outer side, close to the cathode roller core, of the steel support plate is connected to the copper sleeve;

Multiple groups of electrically conductive support rings are disposed on the inner wall of the copper cylinder at equal intervals in an axial direction, the multiple electrically conductive support rings are connected through electrically conductive copper bars, and two ends of the electrically conductive copper bars penetrate through the steel support plate to be in contact with the second copper plates.

Further, each of the electrically conductive support rings comprises a first copper support ring, a steel support ring and a second copper support ring, the steel support ring is located between the first copper support ring and the second copper support ring and is attached to the first copper support ring and the second copper support ring.

Further, the electrically conductive copper bars are annularly arranged along the electrically conductive support rings, and central angles between the adjacent electrically conductive copper bars are identical.

Further, the steel cylinder and the copper cylinder are cylinders rolled from steel-copper explosive clad plates, with a copper layer being located on an inner side and a steel layer being located on an outer side.

Further, an inner surface of the titanium cylinder and outer surfaces of the cylinders rolled from the steel-copper explosive clad plates are coated with silver, and each silver coating has a thickness of 0.1-0.2 mm.

Further, the titanium cylinder is installed on outer surfaces of the cylinders rolled from the steel-copper explosive clad plates through hot assembly;

The copper sleeve is installed on an outer surface of the cathode roller core through hot assembly.

Further, the titanium cylinder is a seamless cylinder obtained through a cold-spinning technique, and a granularity of the titanium cylinder is higher than level 10.

Further, a thickness of the first copper plate is greater than that of the second copper plate, and a diameter of the first copper plate is less than that of the second copper plate.

Further, each group of electrically conductive support rings is integrally connected to the copper cylinder by welding.

Further, multiple lightening holes are regularly formed along a circular surface of the steel support plate.

Compared with the prior art, the invention has the following beneficial effects:

The large-width cathode roller for producing high-strength ultra-thin copper foil is mainly composed of a cathode roller core, a copper sleeve, steel support plates, copper plates, titanium side plates, steel-copper explosive clad cylinders, a titanium cylinder and electrically conductive copper bars.

A large-width seamless titanium cylinder obtained by spinning is used as a working surface for electrolyzing raw foil, cylinders made from steel-copper explosive clad plates are used an a conducting medium, multiple groups of electrically conductive support rings are regularly installed on the inner wall of the steel-copper explosive clad cylinders and are connected through electrically conductive copper bars, and two ends of the electrically conductive copper bars penetrate through the steel support plates to be in contact with the copper plates. That is, the electrically conductive support rings are connected to the copper plates on two sides through the electrically conductive copper bars to form a conducting loop to improve the distribution uniformity of the current on the surface of the cathode roller, the width of the cathode roller can be over 2 m, and actual production proves that the electrical conductivity of the surface of the cathode roller is uniform and the cathode roller can be used for producing high-strength ultra-thin copper foil with a thickness of 4.5 μm.

BRIEF DESCRIPTION OF THE DRAWINGS

The drawings are incorporated in the specification as one part of the specification, and are used for explaining the principle of the invention together with the specification.

To more clearly describe the embodiments of the invention or the technical solutions of the prior art, the drawings required for describing the embodiments of the invention or the prior art will be briefly introduced below. Clearly, those ordinarily skilled in the art can obtain other drawings according to the following ones without creative labor.

Figure 1:
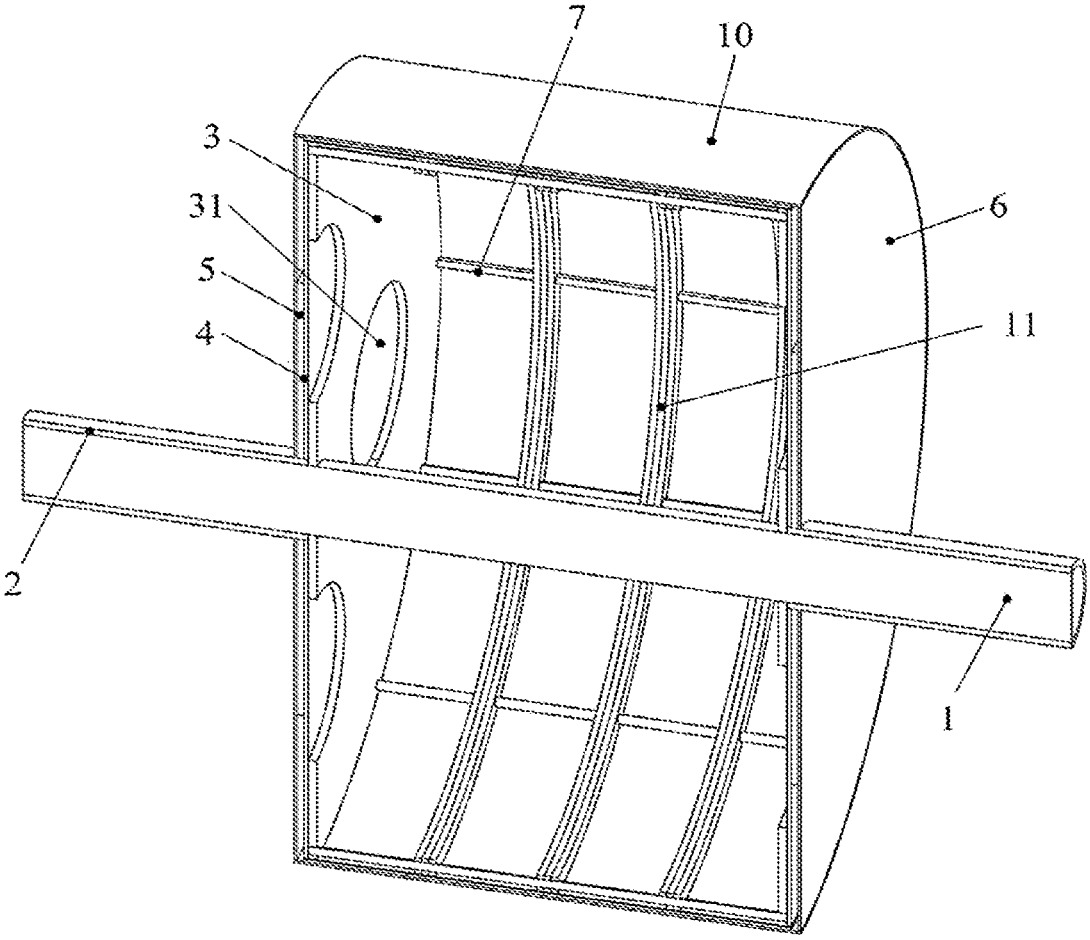
FIG. 1 is a three-dimensional structural view of a large-width cathode roller according to the invention.

Reference signs: 1, cathode roller core; 2, copper sleeve; 3, steel support plate; 4, second copper plate; 5, first copper plate; 6, titanium side plate; 7, electrically conductive copper bar; 8, copper cylinder; 9, steel cylinder; 10, titanium cylinder; 11, electrically conductive support ring; 31, lightening hole; 111, first copper support ring; 112, steel support ring; 113, second copper support ring.

DETAILED DESCRIPTION OF THE PREFERRED EMBODIMENT

Here, illustrative embodiments will be described in detail and are shown in the drawings. Unless otherwise expressed, identical figures involved in the following description and drawings represent identical or similar elements. The implementations described in the following illustrative embodiments are not all possible ones consistent with the invention. They are merely examples of the device consistent with some aspects of the invention described in detail in the appended claims.

To allow those skilled in the art to have a better understanding of the technical solutions of the invention, the invention will be described in further detail below in conjunction with the accompanying drawings and embodiments.

Figure 2:
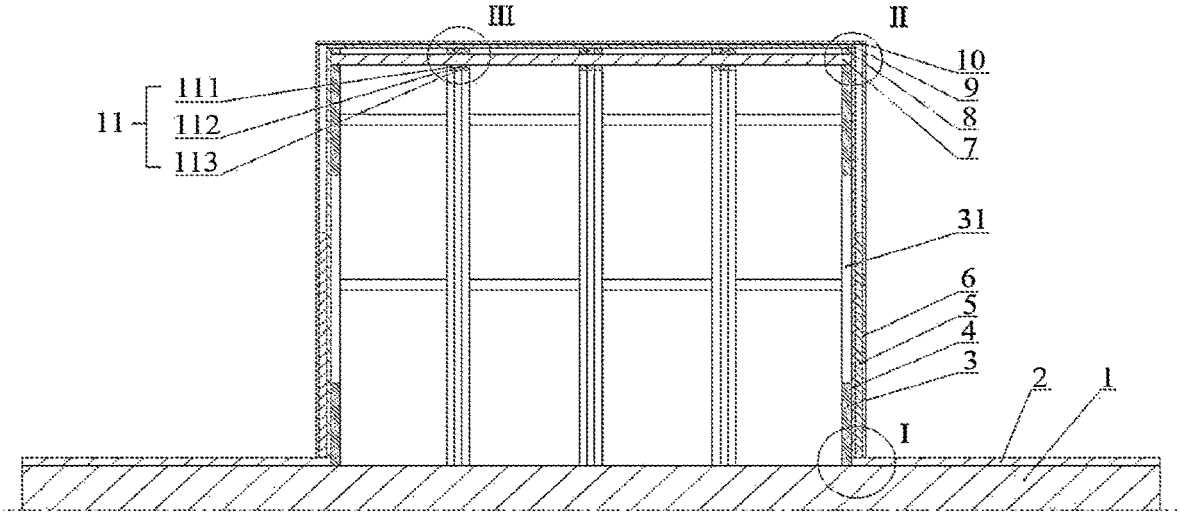
FIG. 2 is an axial sectional structural view of the large-width cathode roller according to the invention.
Figure 3:
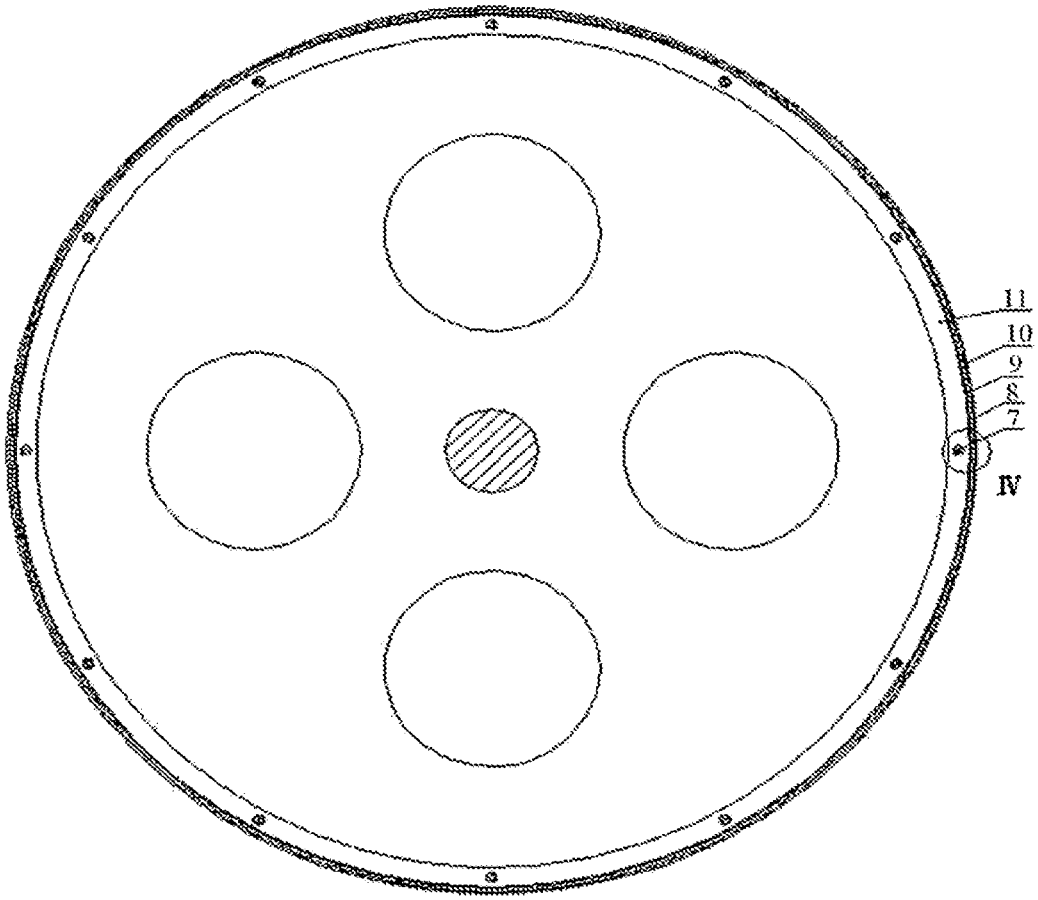
FIG. 3 is a radial sectional structural view of the large-width cathode roller according to the invention.
Figure 4:
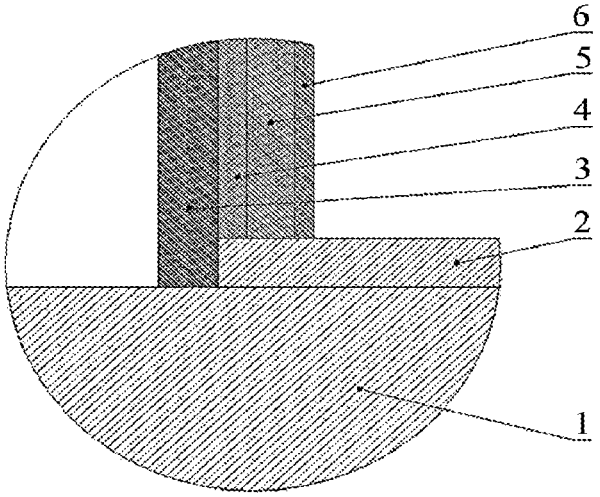
FIG. 4 is an enlarged view of part I in FIG. 2.
Figure 5:
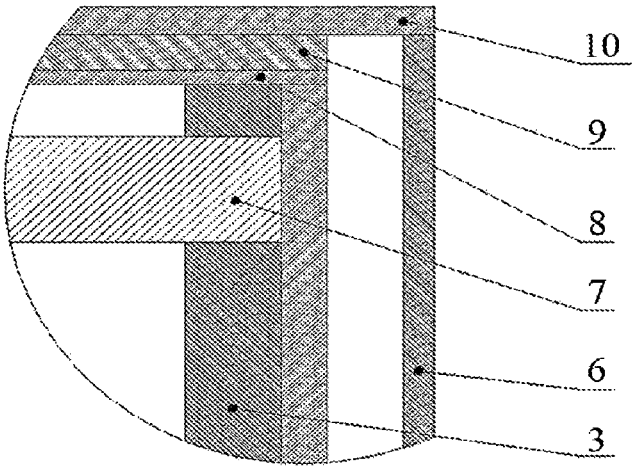
FIG. 5 is an enlarged view of part II in FIG. 2.
Figure 6:
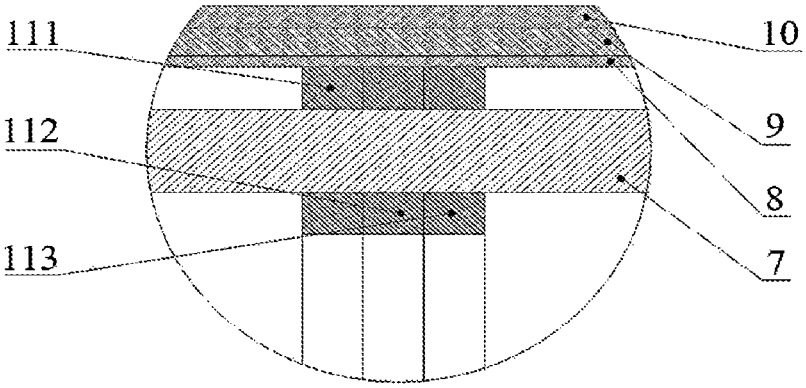
FIG. 6 is an enlarged view of part III in FIG. 2.
Figure 7:
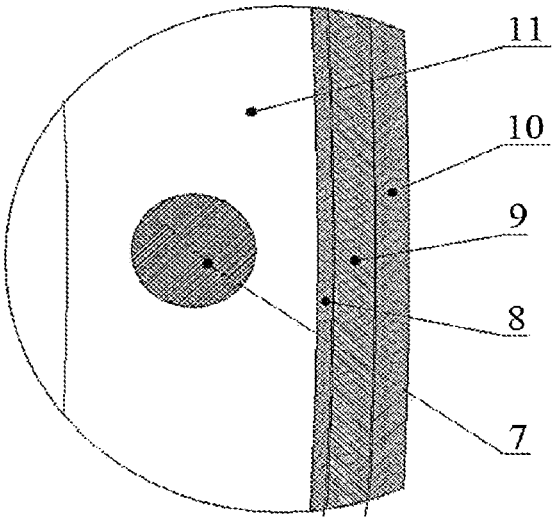
FIG. 7 is an enlarged view of part IV in FIG. 3.

Referring to FIG. 1-FIG. 7, a large-width cathode roller for producing high-strength ultra-thin copper foil comprises a cathode roller core 1, titanium side plates 6 and a titanium cylinder 10, wherein the titanium side plates 6 are welded to two ends of the titanium cylinder 10 to seal the two ends of the titanium cylinder 10, the cathode roller core 1 penetrates through the center of the titanium side plates 6, and preferably, the cathode roller core 1 is made of a steel shaft with high strength.

Wherein, a circumferential structure of the large-width cathode roller is composed of three layers, and specifically comprises a steel cylinder 9 and a copper cylinder 8 which are disposed in the titanium cylinder 10, wherein the steel cylinder 9 is located between the titanium cylinder 10 and the copper cylinder 8 and is in contact with the titanium cylinder 10 and the copper cylinder 8. Preferably, the steel cylinder 9 and the copper cylinder 8 are cylinders rolled from steel-copper explosive clad plates, with a copper layer being located on an inner side and a steel layer being located on an outer side; the titanium cylinder 10 is a seamless cylinder obtained through a powerful cold-spinning technique, and the granularity of the titanium cylinder 10 is required to be higher than level 10.

When the titanium cylinder 10 is connected and assembled to the cylinders rolled from steel-copper explosive clad plates (the steel cylinder 9 and the copper cylinder 8), an inner surface of the titanium cylinder 10 and outer surfaces of the cylinders rolled from steel-copper explosive clad plates are coated with silver, and the thickness of each silver coating is 0.1-0.2 mm; and then, the titanium cylinder 10 is installed on the outer surfaces of the cylinders rolled from steel-copper explosive clad plates through hot assembly and is integrally connected to the outer surfaces of the cylinders rolled from steel-copper explosive clad plates. Because the joint surfaces are coated with silver, the electrical conductivity and stability of the titanium cylinder 10, the steel cylinder 9 and the copper cylinder 8 are improved.

Two side structures of the large-width cathode rollers are symmetrical around the center, and each specifically comprise a first copper plate 5, a second copper plate 4 and a steel support plate 3 which are sequentially disposed on an inner side of each titanium side plate 6, and an inner ring surface of the titanium side plate 6, an inner ring surface of the first copper plate 5 and an inner ring surface of the second copper plate 4 are connected to a copper sleeve 2 disposed around the cathode roller core 1, wherein the copper sleeve 2 is installed on the circumferential surface of the cathode roller core 1 through hot assembly, an outer ring surface of the second copper plate 4 and an outer ring surface of the steel support plate 3 are connected to an inner wall of the copper cylinder 8, an inner ring surface of the steel support plate 3 is connected to the cathode roller core 1, and an outer side, close to the cathode roller core, of the steel support plate 3 is connected to the copper sleeve 2; and the thickness of the first copper plate 5 is greater than that of the second copper plate 4, and the diameter of the first copper plate 5 is less than that of the second copper plate 4. In this way, under the precondition of guaranteeing the electrical conductivity, copper materials are saved to the maximum extent, and the production cost is reduced.

Preferably, multiple lightening holes 31 are regularly formed along a circular surface of the steel support plate 3, such that the weight of the whole cathode roller is reduced under the precondition of guaranteeing the strength of o the whole cathode roller.

In order to guarantee the uniformity of the current on the surface of the large-width cathode roller and the overall structural strength of the large-width cathode roller, multiple groups of electrically conductive support rings 11 are disposed on the inner wall of the copper cylinder 8 at equal intervals in an axial direction; generally, one group of electrically conductive support rings 11 is arranged every 450 mm-650 mm; and the multiple groups of electrically conductive support rings 11 are connected through electrically conductive copper bars 7. As shown, a plurality of through holes are formed in a circular surface of each group of electrically conductive support rings 11, then multiple electrically conductive copper bars 7 are sequentially inserted into the through holes in the electrically conductive support rings 11 in each group, and finally, the two ends of the electrically conductive copper bars 7 penetrate through the steel support plates 3 to be in contact with the second copper plates 4. Through the arrangement that the multiple groups of electrically conductive support rings 11 are connected to the second copper plates 4 on the two sides of the cathode roller through the electrically conductive copper bars 7 to form a conducting loop, the problem of non-uniform distribution of the current on the surface of the titanium cylinder 10 of the large-width cathode roller is solved, and the problem that, when the large-width cathode roller is used for producing copper foil, the current in the middle of the surface of the roller will be weakened, and consequentially, the middle of the copper foil is relatively thin, compromising the product quality is avoided.

Wherein, each electrically conductive support ring 11 comprises a first copper support ring 111, a steel support ring 112 and a second copper support ring 113, wherein the steel support ring 112 is located between the first copper support ring 111 and the second copper support ring 113, is attached to the first copper support ring 111 and the second copper support ring 113, and is connected to the first copper support ring 111 and the second copper support ring 113 by welding. In this way, both the electrical conductivity and the support strength are guaranteed, and each group of electrically conductive support rings 11 are integrally connected to the copper cylinder 8 by welding.

The electrically conductive copper bars 7 are annularly arranged along the electrically conductive support rings 11, and central angles between the adjacent electrically conductive copper bars 7 are identical. For example, if the diameter of the cathode roller is φ2700 mm, twelve electrically conductive copper bars 7 are arranged generally.

According to the above structural arrangement of the large-width cathode roller, the copper sleeve 2 is additionally disposed on the cathode roller core 1, the second copper plates 4 and the first copper plates 5 with good electrical conductivity are additionally arranged on the two sides respectively, multiple groups of electrically conductive support rings 11 are disposed in the cathode roller and are connected through a plurality of electrically conductive copper bars 7, and the two ends of the electrically conductive copper bars 7 are in contact with the second copper plates 4, such that the whole cathode roller is electrically conductive, the current on the surface of the cathode roller can be distributed uniformly to keep the current balanced, and thus, the large-width cathode roller can be used for producing high-strength ultra-thin copper foil.

To verify the technical effects of the invention, the applicant provides the following specific embodiments.

Embodiment 1

The cathode roller provided by the invention has a diameter of φ2700 mm and a width of 1820 mm. The specific implementation is as follows:

(1) Steel-copper explosive clad plates are made through an explosive cladding technique and are rolled to form clad cylinders (the steel cylinder 9 and the copper cylinder 8), with the copper layer being located on the inner side and the steel layer being located on the outer side, wherein the thickness of the copper layer is 7 mm, the thickness of the steel layer is 22 mm, the outer surface of the steel layer is coated with silver, and the thickness of the silver coating is 0.1 mm.

(2) The granularity of the titanium cylinder 10 obtained through the powerful cold-spinning technique is level 11, the width of the titanium cylinder 10 is 1820 mm, the thickness of the titanium cylinder 10 is 10 mm, the inner surface of the titanium cylinder 10 is coated with silver, and the thickness of the silver coating is 0.15 mm.

(3) The electrically conductive support rings 11 are welded to the copper layers of the explosive clad cylinders, and three groups of electrically conductive support rings 11 are regularly distributed in the axial direction of the clad cylinders, wherein each electrically conductive ring 11 is formed by welding the first copper support ring 111, the steel support ring 112 and the second copper support ring 113, and the thickness of each layer is 12 mm.

(4) The electrically conductive support rings 11 are connected to the second copper plates 4 on the two sides of the cathode roller by welding through the electrically conductive copper bars 7; twelve electrically conductive copper bars 7 are regularly distributed in the circumferential direction of the cathode roller, and the diameter of the electrically conductive copper bars 7 is 12 mm.

(5) The steel support plates 3 on the two sides of the cathode rollers are connected to the cathode roller core (steel shaft) 1 by welding, and the steel-copper explosive clad cylinders are connected to the steel support plates 3 on the two sides by welding.

(6) The copper sleeve 2 is installed on the cathode roller core 1 through hot assembly.

(7) The copper plates (including the first copper plates 5 and the second copper plates 4) on the two sides of the cathode roller are connected to the steel sleeve 2 and the steel-copper clad cylinders by welding, the diameter of the second copper plates 4 is φ2622 mm, the thickness of the second copper plates 4 is 12 mm, the diameter of the first copper plates 5 is φ1800 mm, and the thickness of the first copper plates 5 is 20 mm.

(8) The titanium cylinder 10 is installed on the steel-copper clad cylinders through hot assembly.

(9) The titanium side plates 6 on the two sides of the cathode roller are connected to the titanium cylinder 10 by welding.

Embodiment 2

The cathode roller provided by the invention has a diameter of φ2700 mm and a width of 2000 mm. The specific implementation is as follows:

(1) Steel-copper explosive clad plates are made through an explosive cladding technique and are rolled to form clad cylinders (the steel cylinder 9 and the copper cylinder 8), with the copper layer being located on the inner side and the steel layer being located on the outer side, wherein the thickness of the copper layer is 8 mm, the thickness of the steel layer is 22 mm, the outer surface of the steel layer is coated with silver, and the thickness of the silver coating is 0.2 mm.

(2) The granularity of the titanium cylinder 10 obtained through the powerful cold-spinning technique is level 12, the width of the titanium cylinder 10 is 2000 mm, the thickness of the titanium cylinder 10 is 10 mm, the inner surface of the titanium cylinder 10 is coated with silver, and the thickness of the silver coating is 0.2 mm.

(3) The electrically conductive support rings 11 are welded to the copper layers of the explosive clad cylinders, and four groups of electrically conductive support rings 11 are regularly distributed in the axial direction of the clad cylinders, wherein each electrically conductive ring 11 is formed by welding the first copper support ring 111, the steel support ring 112 and the second copper support ring 113, and the thickness of each layer is 12 mm.

(4) The electrically conductive support rings 11 are connected to the second copper plates 4 on the two sides of the cathode roller by welding through the electrically conductive copper bars 7; twelve electrically conductive copper bars 7 are regularly distributed in the circumferential direction of the cathode roller, and the diameter of the electrically conductive copper bars 7 is 12 mm.

(5) The steel support plates 3 on the two sides of the cathode rollers are connected to the cathode roller core (steel shaft) 1 by welding, and the steel-copper explosive clad cylinders are connected to the steel support plates 3 on the two sides by welding.

(6) The copper sleeve 2 is installed on the cathode roller core 1 through hot assembly.

(7) The copper plates (including the first copper plates 5 and the second copper plates 4) on the two sides of the cathode roller are connected to the steel sleeve 2 and the steel-copper clad cylinders by welding, the diameter of the second copper plates 4 is φ2622 mm, the thickness of the second copper plates 4 is 12 mm, the diameter of the first copper plates 5 is φ1800 mm, and the thickness of the first copper plates 5 is 20 mm.

(8) The titanium cylinder 10 is installed on the steel-copper clad cylinders through hot assembly.

(9) The titanium side plates 6 on the two sides of the cathode roller are connected to the titanium cylinder 10 by welding.

Embodiment 3

The cathode roller provided by the invention has a diameter of φ2000 mm and a width of 2000 mm. The specific implementation is as follows:

(1) Steel-copper explosive clad plates are made through an explosive cladding technique and are rolled to form clad cylinders (the steel cylinder 9 and the copper cylinder 8), with the copper layer being located on the inner side and the steel layer being located on the outer side, wherein the thickness of the copper layer is 6 mm, the thickness of the steel layer is 22 mm, the outer surface of the steel layer is coated with silver, and the thickness of the silver coating is 0.15 mm.

(2) The granularity of the titanium cylinder 10 obtained through the powerful cold-spinning technique is level 11, the width of the titanium cylinder 10 is 2000 mm, the thickness of the titanium cylinder 10 is 10 mm, the inner surface of the titanium cylinder 10 is coated with silver, and the thickness of the silver coating is 0.15 mm.

(3) The electrically conductive support rings 11 are welded to the copper layers of the explosive clad cylinders, and three groups of electrically conductive support rings 11 are regularly distributed in the axial direction of the clad cylinders, wherein each electrically conductive ring 11 is formed by welding the first copper support ring 111, the steel support ring 112 and the second copper support ring 113, and the thickness of each layer is 12 mm.

(4) The electrically conductive support rings 11 are connected to the second copper plates 4 on the two sides of the cathode roller by welding through the electrically conductive copper bars 7; eight electrically conductive copper bars 7 are regularly distributed in the circumferential direction of the cathode roller, and the diameter of the electrically conductive copper bars 7 is 12 mm.

(5) The steel support plates 3 on the two sides of the cathode rollers are connected to the cathode roller core (steel shaft) 1 by welding, and the steel-copper explosive clad cylinders are connected to the steel support plates 3 on the two sides by welding.

(6) The copper sleeve 2 is installed on the cathode roller core 1 through hot assembly.

(7) The copper plates (including the first copper plates 5 and the second copper plates 4) on the two sides of the cathode roller are connected to the steel sleeve 2 and the steel-copper clad cylinders by welding, the diameter of the second copper plates 4 is φ1924 mm, the thickness of the second copper plates 4 is 12 mm, the diameter of the first copper plates 5 is φ1000 mm, and the thickness of the first copper plates 5 is 20 mm.

(8) The titanium cylinder 10 is installed on the steel-copper clad cylinders through hot assembly.

(9) The titanium side plates 6 on the two sides of the cathode roller are connected to the titanium cylinder 10 by welding.

Actual production proves that the large-width cathode rollers in the above three embodiments all can produce high-strength ultra-thin copper foil with a thickness of 4.5 μm; and the quality of copper foil is good, and technical problems caused by non-uniform distribution of the current on the surface of the cathode roller are solved.

The above embodiments are merely specific ones of the invention, which are provided to help those skilled in the art understand or implement the invention. It is obvious to those skilled in the art to make various modifications of these embodiments. The general principle defined in this specification can be implemented in other embodiments without departing from the spirit or scope of the invention.

It should be understood that the invention is not limited to the above description, and various modifications and changes can be made to the invention without departing from the scope of the invention. The scope of the invention is limited merely by the appended claims.

What is claimed is:

1. A large-width cathode roller for producing high-strength ultra-thin copper foil, comprising a cathode roller core (1), titanium side plates (6) and a titanium cylinder (10), wherein two ends of the titanium cylinder (10) are sealed by the titanium side plates (6), and the cathode roller core (1) penetrates through a center of the titanium side plates (6);

a steel cylinder (9) and a copper cylinder (8) are disposed in the titanium cylinder (10), and the steel cylinder (9) is located between the titanium cylinder (10) and the copper cylinder (8) and is in contact with the titanium cylinder (10) and the copper cylinder (8);

a first copper plate (5), a second copper plate (4) and a steel support plate (3) are sequentially connected to and disposed on an inner side of each said titanium side plate (6); an inner ring surface of the titanium side plate (6), an inner ring surface of the first copper plate (5) and an inner ring surface of the second copper plate (4) are all connected to a copper sleeve (2) disposed around the cathode roller core (1), an outer ring surface of the second copper plate (4) and an outer ring surface of the steel support plate (3) are connected to an inner wall of the copper cylinder (8), an inner ring surface of the steel support plate (3) is connected to the cathode roller core (1), and an outer side, close to the cathode roller core (1), of the steel support plate (3) is connected to the copper sleeve (2);

multiple groups of electrically conductive support rings (11) are disposed on the inner wall of the copper cylinder (8) at equal intervals in an axial direction, the multiple electrically conductive support rings (11) are connected through electrically conductive copper bars (7), and two ends of the electrically conductive copper bars (7) penetrate through the steel support plates (3) to be in contact with the second copper plates (4);

each of the electrically conductive support rings (11) comprises a first copper support ring (111), a steel support ring (112) and a second copper support ring (113), the steel support ring (112) is located between the first copper support ring (111) and the second copper support ring (113) and is attached to the first copper support ring (111) and the second copper support ring (113);

the electrically conductive copper bars (7) are annularly arranged along the electrically conductive support rings (11), and central angles between the adjacent electrically conductive copper bars (7) are identical.

2. The large-width cathode roller for producing high-strength ultra-thin copper foil according to claim 1, wherein the steel cylinder (9) and the copper cylinder (8) are cylinders rolled from steel-copper explosive clad plates, with a copper layer being located on an inner side and a steel layer being located on an outer side.

3. The large-width cathode roller for producing high-strength ultra-thin copper foil according to claim 2, wherein an inner surface of the titanium cylinder (10) and outer surfaces of the cylinders rolled from the steel-copper explosive clad plates are coated with silver, and each silver coating has a thickness of 0.1-0.2 mm.

4. The large-width cathode roller for producing high-strength ultra-thin copper foil according to claim 2, wherein the titanium cylinder (10) is installed on outer surfaces of the cylinders rolled from the steel-copper explosive clad plates through hot assembly;

the copper sleeve (2) is installed on an outer surface of the cathode roller core (1) through hot assembly.

5. The large-width cathode roller for producing high-strength ultra-thin copper foil according to claim 1, wherein the titanium cylinder (10) is a seamless cylinder obtained through a cold-spinning technique, and a granularity of the titanium cylinder (10) is higher than level 10.

6. The large-width cathode roller for producing high-strength ultra-thin copper foil according to claim 1, wherein a thickness of the first copper plate (5) is greater than that of the second copper plate (4), and a diameter of the first copper plate (5) is less than that of the second copper plate (4).

7. The large-width cathode roller for producing high-strength ultra-thin copper foil according to claim 1, wherein each group of electrically conductive support rings (11) is integrally connected to the copper cylinder (8) by welding.

8. The large-width cathode roller for producing high-strength ultra-thin copper foil according to claim 1, wherein multiple lightening holes (31) are regularly formed along a circular surface of the steel support plate (3).

* * * * *